US006552639B2

(12) United States Patent
Decristofaro et al.

(10) Patent No.: US 6,552,639 B2
(45) Date of Patent: Apr. 22, 2003

(54) BULK STAMPED AMORPHOUS METAL MAGNETIC COMPONENT

(75) Inventors: Nicholas J. Decristofaro, Chatham, NJ (US); Gordon E. Fish, Upper Montclair, NJ (US); Scott M. Lindquist, Myrtle Beach, SC (US); Peter J. Stamatis, Morristown, NJ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/842,078

(22) Filed: Apr. 25, 2001

(65) Prior Publication Data

US 2001/0043134 A1 Nov. 22, 2001

Related U.S. Application Data

(60) Provisional application No. 60/200,563, filed on Apr. 28, 2000.

(51) Int. Cl.[7] ..... H01F 5/00

(52) U.S. Cl. ..... 335/216; 335/299

(58) Field of Search ..... 335/302–301, 335/299, 216; 324/318–321

(56) References Cited

U.S. PATENT DOCUMENTS

| | | | | |
|---|---|---|---|---|
| 4,672,346 | A | | 6/1987 | Miyamoto et al. |
| 4,734,975 | A | | 4/1988 | Ballard et al. |
| 4,766,378 | A | | 8/1988 | Danby et al. |
| 4,818,966 | A | | 4/1989 | Miyamoto et al. |
| 4,827,235 | A | | 5/1989 | Inomata et al. |
| 4,887,059 | A | | 12/1989 | Asano et al. |
| 4,892,773 | A | | 1/1990 | Chenoweth et al. |
| 5,061,897 | A | | 10/1991 | Danby et al. |
| 5,124,651 | A | | 6/1992 | Danby et al. |
| 5,134,771 | A | | 8/1992 | Lee et al. |
| 5,283,544 | A | | 2/1994 | Sakurai et al. |
| 5,495,222 | A | | 2/1996 | Abele et al. |
| 5,754,085 | A | | 5/1998 | Danby et al. |
| 5,798,680 | A | | 8/1998 | Abele et al. |
| 5,963,117 | A | | 10/1999 | Ohashi et al. |
| 6,014,070 | A | | 1/2000 | Danby et al. |
| 6,150,819 | A | * | 11/2000 | Laskaris et al. ..... 324/319 |

FOREIGN PATENT DOCUMENTS

| | | |
|---|---|---|
| EP | 0 984 461 A2 | 3/2000 |
| EP | 1 004 888 A1 | 5/2000 |
| EP | 1 004 889 A2 | 5/2000 |
| EP | 1 004 889 A3 | 5/2000 |
| JP | 56 026412 | 3/1981 |
| JP | 57 035308 | 2/1982 |
| JP | 57 198608 | 12/1982 |
| JP | 58-148419 | 3/1983 |
| JP | 58 148419 | 9/1983 |
| JP | 59-181504 | 10/1984 |
| JP | 59 229812 | 12/1984 |
| JP | 61-131518 | 6/1986 |
| WO | WO 94/14994 | 7/1994 |
| WO | WO 95/21044 | 8/1995 |
| WO | WO 95/33596 | 12/1995 |
| WO | WO 96/00449 | 1/1996 |

* cited by examiner

*Primary Examiner*—Lincoln Donovan
(74) *Attorney, Agent, or Firm*—Roger H. Criss

(57) ABSTRACT

A bulk amorphous metal magnetic component has a plurality of laminations of ferromagnetic amorphous metal strips adhered together to form a generally three-dimensional part having the shape of a polyhedron. The component is formed by stamping, stacking and bonding. The bulk amorphous metal magnetic component may include an arcuate surface, and an implementation may include two arcuate surfaces that are disposed opposite each other. The magnetic component may be operable at frequencies ranging from between approximately 50 Hz and 20,000 Hz. When the component is excited at an excitation frequency "f" to a peak induction level $B_{max}$, it may exhibit a core-loss less than "L" wherein L is given by the formula $L=0.0074\ f(B_{max})^{1.3}+0.000282\ f^{1.5}(B_{max})^{2.4}$, said core loss, said excitation frequency and said peak induction level being measured in watts per kilogram, hertz, and teslas, respectively.

11 Claims, 4 Drawing Sheets

BULK STAMPED AMORPHOUS METAL MAGNETIC COMPONENT

This application claims the benefit of Ser. No. 60/200,563, filed Apr. 28, 2000.

BACKGROUND OF THE INVENTION

1. Field of The Invention

This invention relates to amorphous metal magnetic components; and more particularly, to a generally three-dimensional bulk stamped amorphous metal magnetic component for large electronic devices such as magnetic resonance imaging systems, television and video systems, and electron and ion beam systems.

2. Description Of The Prior Art

Magnetic resonance imaging (MRI) has become an important, non-invasive diagnostic tool in modern medicine. An MRI system typically comprises a magnetic field generating device. A number of such field generating devices employ either permanent magnets or electromagnets as a source of magnetomotive force. Frequently the field generating device further comprises a pair of magnetic pole faces defining a gap with the volume to be imaged contained within this gap.

U.S. Pat. No. 4,672,346 teaches a pole face having a solid structure and comprising a plate-like mass formed from a magnetic material such as carbon steel. U.S. Pat. No. 4,818,966 teaches that the magnetic flux generated from the pole pieces of a magnetic field generating device can be concentrated in the gap therebetween by making the peripheral portion of the pole pieces from laminated magnetic plates. U.S. Pat. No. 4,827,235 discloses a pole piece having large saturation magnetization, soft magnetism, and a specific resistance of 20 $\mu\Omega$-cm or more. Soft magnetic materials including permalloy, silicon steel, amorphous magnetic alloy, ferrite, and magnetic composite material are taught for use therein.

U.S. Pat. No. 5,124,651 teaches a nuclear magnetic resonance scanner with a primary field magnet assembly. The assembly includes ferromagnetic upper and lower pole pieces. Each pole piece comprises a plurality of narrow, elongated ferromagnetic rods aligned with their long axes parallel to the polar direction of the respective pole piece. The rods are preferably made of a magnetically permeable alloy such as 1008 steel, soft iron, or the like. The rods are transversely electrically separated from one another by an electrically non-conductive medium, limiting eddy current generation in the plane of the faces of the poles of the field assembly. U.S. Pat. No. 5,283,544, issued Feb. 1, 1994, to Sakurai et al. discloses a magnetic field generating device used for MRI. The devices include a pair of magnetic pole pieces which may comprise a plurality of block-shaped magnetic pole piece members formed by laminating a plurality of non-oriented silicon steel sheets.

Notwithstanding the advances represented by the above disclosures, there remains a need in the art for improved pole pieces. This is so because these pole pieces are essential for improving the imaging capability and quality of MRI systems.

Although amorphous metals offer superior magnetic performance when compared to non-oriented electrical steels, they have long been considered unsuitable for use in bulk magnetic components such as the tiles of poleface magnets for MRI systems due to certain physical properties of amorphous metal and the corresponding fabricating limitations. For example, amorphous metals are thinner and harder than non-oriented silicon steel. Consequently, conventional cutting and stamping processes cause fabrication tools and dies to wear more rapidly. The resulting increase in the tooling and manufacturing costs makes fabricating bulk amorphous metal magnetic components using such techniques as conventionally practiced commercially impractical. The thinness of amorphous metals also translates into an.increased number of laminations in the assembled components, further increasing the total cost of the amorphous metal magnetic component.

Amorphous metal is typically supplied in a thin continuous ribbon having a uniform ribbon width. However, amorphous metal is a very hard material making it very difficult to cut or form easily, and once annealed to achieve peak magnetic properties, it becomes very brittle. This makes it difficult and expensive to use conventional approaches to construct a bulk amorphous metal magnetic component. The brittleness of amorphous metal may also cause concern for the durability of the bulk magnetic component in an application such as an MRI system.

Another problem with bulk amorphous metal magnetic components is that the magnetic permeability of amorphous metal material is reduced when it is subjected to physical stresses. This reduction in permeability may be considerable depending upon the intensity of the stresses on the amorphous metal material. As a bulk amorphous metal magnetic component is subjected to stresses, the efficiency at which the core directs or focuses magnetic flux is reduced. This results in higher magnetic losses, increased heat production, and reduced power. Such stress sensitivity, due to the magnetostrictive nature of the amorphous metal, may be caused by stresses resulting from magnetic forces during operation of the device, mechanical stresses resulting from mechanically clamping or otherwise fixing the bulk amorphous metal magnetic components in place, or internal stresses caused by the thermal expansion and/or expansion due to magnetic saturation of the amorphous metal material.

SUMMARY OF THE INVENTION

The present invention provides a low-loss, bulk amorphous metal magnetic component having the shape of a polyhedron or other three-dimensional (3-D) shape and being comprised of a plurality of layers of ferromagnetic, amorphous metal strips. Also provided by the present invention is a method for making a bulk amorphous metal magnetic component. The magnetic component is operable at frequencies ranging from about 50 Hz to 20,000 Hz and exhibits improved performance characteristics when compared to silicon-steel magnetic components operated over the same frequency range. A magnetic component constructed in accordance with the present invention and excited at an excitation frequency "f" to a peak induction level "$B_{max}$" will have a core loss at room temperature less than "L" wherein L is given by the formula $L=0.0074\ f(B_{max})^{1.3}+0.000282\ f^{1.5}(B^{max})^{2.4}$, the core loss, the excitation frequency and the peak induction level being measured in watts per kilogram, hertz, and teslas, respectively. The magnetic component will have (i) a core-loss of less than or approximately equal to 1 watt-per-kilogram of amorphous metal material when operated at a frequency of approximately 60 Hz and at a flux density of approximately 1.4 Tesla (T); (ii) a core-loss of less than or approximately equal to 12 watts-per-kilogram of amorphous metal material when operated at a frequency of approximately 1000 Hz and at a flux density of approximately 1.0 T, or (iii) a core-loss of less than or approximately equal to 70 watt-per-kilogram of amorphous metal material when operated at a frequency of approximately 20,000 Hz and at a flux density of approximately 0.30T.

In one embodiment of the present invention, a bulk amorphous metal magnetic component comprises a plurality of substantially similarly shaped layers of amorphous metal strips laminated together to form a polyhedrally shaped part.

The present invention also provides methods of constructing a bulk amorphous metal magnetic component. An implementation includes the steps of stamping laminations in the requisite shape from ferromagnetic amorphous metal strip feedstock, stacking the laminations to form a three-dimensional shape, applying and activating adhesive means to adhere the laminations to each other forming a component having sufficient mechanical integrity, and finishing the component to remove any excess adhesive and to give it a suitable surface finish and final component dimensions. The method may further comprise an optional annealing step to improve the magnetic properties of the component. These steps may be carried out in a variety of orders and using a variety of techniques including those set forth hereinbelow.

The present invention is also directed to a bulk amorphous metal component constructed in accordance with the above-described methods. In particular, bulk amorphous metal magnetic components constructed in accordance with the present invention are especially suited for amorphous metal components such as tiles for poleface magnets in high performance MRI systems, television and video systems, and electron and ion beam systems. Bulk amorphous magnetic components constructed in accordance with the present invention are also useful for non-toroidal shaped inductors such as C-cores, E-cores and E/I-cores, wherein the terminology C, E and E/I is descriptive of the cross-sectional shape of the components. The advantages afforded by the present invention include simplified manufacturing, reduced manufacturing time, reduced stresses (e.g., magnetostrictive) encountered during construction of bulk amorphous metal components, and optimized performance of the finished amorphous metal magnetic component.

BRIEF DESCRIPTION OF THE DRAWINGS

The invention will be more fully understood and further advantages will become apparent when reference is had to the following detailed description of the preferred embodiments of the invention and the accompanying drawings, wherein like reference numerals denote similar elements throughout the several views, and in which.

DETAILED DESCRIPTION

Figure 1A:
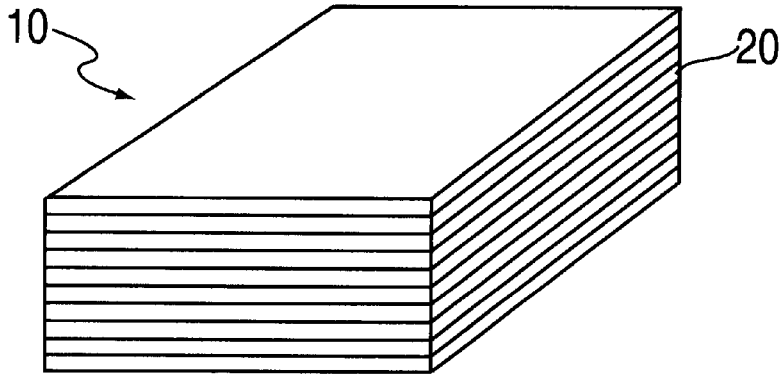
FIG. 1A is a perspective view of a bulk stamped amorphous metal magnetic component having the shape of a generally rectangular polyhedron constructed in accordance with the present invention.

The present invention provides a generally polyhedrally shaped low-loss bulk amorphous metal component. Bulk amorphous metal components are constructed in accordance with the present invention having various three-dimensional (3-D) geometries including, but not limited to, rectangular, square, and trapezoidal prisms. In addition, any of the previously mentioned geometric shapes may include at least one arcuate surface, and implementations may include two oppositely disposed arcuate surfaces to form a generally curved or arcuate bulk amorphous metal component. Furthermore, complete magnetic devices such as poleface magnets may be constructed as bulk amorphous metal components in accordance with the present invention. Those devices may have either a unitary construction or they may be formed from a plurality of pieces which collectively form the completed device. Alternatively, a device may be a composite structure comprised entirely of amorphous metal parts or a combination of amorphous metal parts with other magnetic materials.

A magnetic resonance (MRI) imaging device frequently employs a magnetic pole piece (also called a pole face) as part of a magnetic field generating means. As is known in the art, such a field generating means is used to provide a steady magnetic field and a time-varying magnetic field gradient superimposed thereon. In order to produce a high-quality, high-resolution MRI image it is essential that the steady field be homogeneous over the entire sample volume to be studied and that the field gradient be well defined. This homogeneity can be enhanced by use of suitable pole pieces. The bulk amorphous metal magnetic component of the invention is suitable for use in constructing such a pole face.

The pole pieces for an MRI or other magnet system are adapted to shape and direct in a predetermined way the magnetic flux which results from at least one source of magnetomotive force (mmf). The source may comprise known mmf generating means, including permanent magnets and electromagnets with either normally conductive or superconducting windings. Each pole piece may comprise one or more bulk amorphous metal magnetic components as described herein.

It is desired that a pole piece exhibit good DC magnetic properties including high permeability and high saturation flux density. The demands for increased resolution and higher operating flux density in MRI systems have imposed a further requirement that the pole piece also have good AC magnetic properties. More specifically, it is necessary that the core loss produced in the pole piece by the time-varying gradient field be minimized. Reducing the core loss advantageously improves the definition of the magnetic field gradient and allows the field gradient to be varied more rapidly, thus allowing reduced imaging time without compromise of image quality.

The earliest magnetic pole pieces were made from solid magnetic material such as carbon steel or high purity iron, often known in the art as Armco iron. They have excellent DC properties but very high core loss in the presence of AC fields because of macroscopic eddy currents. Some improvement is gained by forming a pole piece of laminated conventional steels.

Yet there remains a need for further improvements in pole pieces, which exhibit not only the required DC properties but also substantially improved AC properties; the most important property being lower core loss. As will be explained below, the requisite combination of high magnetic flux density, high magnetic permeability, and low core loss is afforded by use of the magnetic component of the present invention in the construction of pole pieces.

Figure 1B:
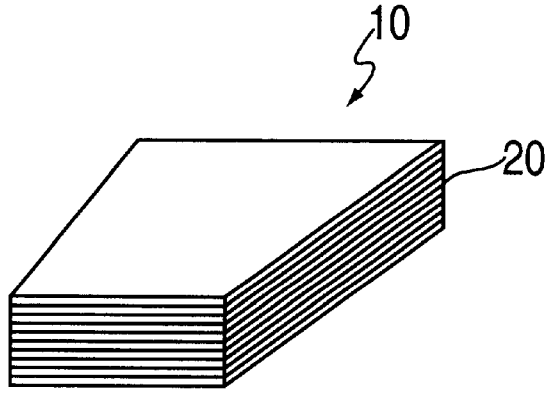
FIG. 1B is a perspective view of a bulk stamped amorphous metal magnetic component having the shape of a generally trapezoidal polyhedron constructed in accordance with the present invention.
Figure 1C:
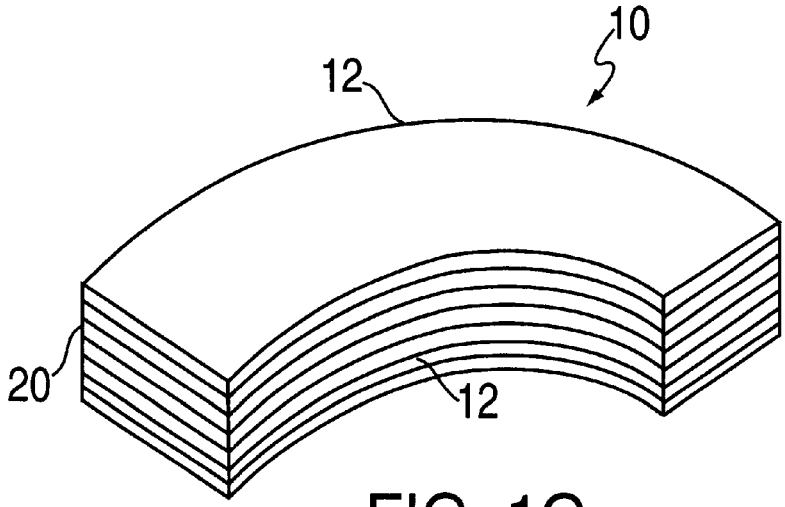
FIG. 1C is a perspective view of a bulk stamped amorphous metal magnetic component having the shape of a polyhedron with oppositely disposed arcuate surfaces and constructed in accordance with the present invention.

Referring now to FIGS. 1A to 1C in detail, FIG. 1A illustrates a bulk amorphous metal magnetic component 10 having a three-dimensional generally rectangular shape. The magnetic component 10 is comprised of a plurality of substantially similarly shaped layers of ferromagnetic amorphous metal strip material 20 that are laminated together and annealed. The magnetic component depicted in FIG. 1B has a three-dimensional generally trapezoidal shape and is comprised of a plurality of layers of ferromagnetic amorphous metal strip material 20 that are each substantially the same size and shape and that are laminated together and annealed. The magnetic component depicted in FIG. 1C includes two oppositely disposed arcuate surfaces 12. The component 10 is constructed of a plurality of substantially similarly shaped layers of ferromagnetic amorphous metal strip material 20 that are laminated together and annealed.

The bulk amorphous metal magnetic component 10 of the present invention is a generally three-dimensional polyhedron, and may be a generally rectangular, square or trapezoidal prism. Alternatively, and as depicted in FIG. 1C, the component 10 may have at least one arcuate surface 12, and as shown may include two arcuate surfaces disposed opposite each other.

A three-dimensional magnetic component 10 constructed in accordance with the present invention exhibits low core loss. When excited at an excitation frequency "f" to a peak induction level "$B_{max}$", the component will have a core loss at room temperature less than "L" wherein L is given by the formula $L=0.0074\ f(B_{max})^{1.3}+0.000282\ f^{1.5}(B_{max})^{2.4}$, the core loss, the excitation frequency and the peak induction level being measured in watts per kilogram, hertz, and teslas, respectively. In another embodiment, the magnetic component has (i) a core-loss of less than or approximately equal to 1 watt-per-kilogram of amorphous metal material when operated at a frequency of approximately 60 Hz and at a flux density of approximately 1.4 Tesla (T); (ii) a core-loss of less than or approximately equal to 12 watts-per-kilogram of amorphous metal material when operated at a frequency of approximately 1000 Hz and at a flux density of approximately 1.0 T, or (iii) a core-loss of less than or approximately equal to 70 watt-per-kilogram of amorphous metal material when operated at a frequency of approximately 20,000 Hz and at a flux density of approximately 0.30T. The reduced core loss of the component of the invention advantageously improves the efficiency of an electrical device comprising it.

The low values of core loss make the bulk magnetic component of the invention especially suited for applications wherein the component is subjected to a high frequency magnetic excitation, e.g., excitation occurring at a frequency of at least about 100 Hz. The inherent high core loss of conventional steels at high frequency renders them unsuitable for use in devices requiring high frequency excitation. These core loss performance values apply to the various embodiments of the present invention, regardless of the specific geometry of the bulk amorphous metal component.

The present invention also provides a method of constructing a bulk amorphous metal component. In an implementation, the method comprises the steps of stamping laminations in the requisite shape from ferromagnetic amorphous metal strip feedstock, stacking the laminations to form a three-dimensional object, applying and activating adhesive means to adhere the laminations to each other and give the component sufficient mechanical integrity, and finishing the component to remove any excess adhesive and give it a suitable surface finish and final component dimensions. The method may further comprise an optional annealing step to improve the magnetic properties of the component. These steps may be carried out in a variety of orders and using a variety of techniques including those set forth hereinbelow and others which will be obvious to those skilled in the art.

Historically, three factors have combined to preclude the use of stamping as a viable approach to forming amorphous metal parts. First and foremost, amorphous metal strip is typically thinner than conventional magnetic material strip such as non-oriented electrical steel sheet. The use of thinner materials dictates that more laminations are required to build a given-shaped part. The use of thinner materials also requires smaller tool and die clearances in the stamping process.

Secondly, amorphous metals tend to be significantly harder than typical metallic punch and die materials. Iron based amorphous metal typically exhibits hardness in excess of 1100 kg/mm$^2$. By comparison, air cooled, oil quenched and water quenched tool steels are restricted to hardness in the 800 to 900 kg/mm$^2$ range. Thus, the amorphous metals, which derive their hardness from their unique atomic structures and chemistries, are harder than conventional metallic punch and die materials.

Thirdly, amorphous metals can undergo significant deformation, rather than rupture, prior to failure when constrained between the punch and die during stamping. Amorphous metals deform by highly localized shear flow. When deformed in tension, such as when an amorphous metal strip is pulled, the formation of a single shear band can lead to failure at small, overall deformation. In tension, failure can occur at an elongation of 1% or less. However, when deformed in a manner such that a mechanical constraint precludes plastic instability, such as in bending between the tool and die during stamping, multiple shear bands are formed and significant localized deformation can occur. In such a deformation mode, the elongation at failure can locally exceed 100%.

These latter two factors, exceptional hardness plus significant deformation, combine to produce extraordinary wear on the punch and die components of the stamping press using conventional stamping equipment, tooling and processes. Wear on the punch and die occurs by direct abrasion of the hard amorphous metal rubbing against the softer punch and die materials during deformation prior to failure.

The present invention provides a method for minimizing the wear on the punch and die during the stamping process.

The method comprises the steps of fabricating the punch and die tooling from carbide materials, fabricating the tooling such that the clearance between the punch and the die is small and uniform, and operating the stamping process at high strain rates. The carbide materials used for the punch and die tooling should have a hardness of at least 1100 $kg/mm^2$ and preferably greater than 1300 $kg/mm^2$. Carbide tooling with hardness equal to or greater than that of amorphous metal will resist direct abrasion from the amorphous metal during the stamping process thereby minimizing the wear on the punch and die. The clearance between the punch and the die should be less than 0.050 mm (0.002 inch) and preferably less than 0.025 mm (0.001 inch). The strain rate used in the stamping process should be that created by at least one punch stroke per second and preferably at least five punch strokes per second. For amorphous metal strip that is 0.025 mm (0.001 inch) thick, this range of stroke speeds is approximately equivalent to a deformation rate of at least $10^5$/sec and preferably at least $5\times10^5$/sec. The small clearance between the punch and the die and the high strain rate used in the stamping process combine to limit the amount of mechanical deformation of the amorphous metal prior to failure during the stamping process. Limiting the mechanical deformation of the amorphous metal in the die cavity limits the direct abrasion between the amorphous metal and the punch and die process thereby minimizing the wear on the punch and die.

The magnetic properties of the amorphous metal strip appointed for use in component 10 of the present invention may be enhanced by thermal treatment at a temperature and for a time sufficient to provide the requisite enhancement without altering the substantially fully glassy microstructure of the strip. A magnetic field may optionally be applied to the strip during at least a portion, such as during at least the cooling portion, of the heat treatment.

The thermal treatment of the amorphous metal used in the invention may employ any heating means which results in the metal experiencing the required thermal profile. Suitable heating means include infra-red heat sources, ovens, fluidized beds, thermal contact with a heat sink maintained at an elevated temperature, resistive heating effected by passage of electrical current through the strip, and inductive (RF) heating. The choice of heating means may depend on the ordering of the required processing steps enumerated above.

Furthermore, the heat treatment may be carried out either on strip material prior to the stamping step, on discrete laminations after the stamping step but before the stacking step, or on a stack subsequent to the stacking step. The heat treatment may be done prior to the stamping step in a separate, off-line batch process on bulk spools of feedstock material, preferably in an oven or fluidized bed, or in a continuous spool-to-spool process passing the strip from a payoff spool, through a heated zone, and onto a take-up spool. Alternatively the heat treatment may be done in-line by passing the ribbon continuously from a payoff spool through a heated zone and thereafter into the punch press for subsequent punching and stacking steps.

The heat treatment also may be carried out on discrete laminations after the punching step but before stacking. In this embodiment, it is preferred that the laminations exit the punch and are directly deposited onto a moving belt which conveys them through a heated zone, thereby causing the laminations to experience the appropriate time-temperature profile.

In another implementation, the heat treatment is carried out after discrete laminations are stacked in registry. Suitable heating means for annealing such a stack include ovens, fluidized beds, and induction heating.

Adhesive means are used to adhere a plurality of laminations of amorphous metal material in registry to each other, thereby allowing construction of a bulk, three-dimensional object with sufficient structural integrity for handling, use, or incorporation into a larger structure. A variety of adhesives may be suitable, including epoxies, varnishes, anaerobic adhesives, and room-temperature-vulcanized (RTV) silicone materials. Adhesives desirably have low viscosity, low shrinkage, low elastic modulus, high peel strength, and high dielectric strength. Epoxies may be either multi-part whose curing is chemically activated or single-part whose curing is activated thermally or by exposure to ultra-violet radiation. Suitable methods for applying the adhesive include dipping, spraying, brushing, and electrostatic deposition. In strip or ribbon form amorphous metal may also be coated by passing it over rods or rollers which transfer adhesive to the amorphous metal. Rollers or rods having a textured surface, such as gravure or wire-wrapped rollers, are especially effective in transferring a uniform coating of adhesive onto the amorphous metal. The adhesive may be applied to an individual layer of amorphous metal at a time, either to strip material prior to punching or to laminations after punching. Alternatively, the adhesive means may be applied to the laminations collectively after they are stacked. In this case, the stack is impregnated by capillary flow of the adhesive between the laminations. The stack may be placed either in vacuum or under hydrostatic pressure to effect more complete filling, yet minimizing the total volume of adhesive added, thus assuring high stacking factor.

Figure 2A:
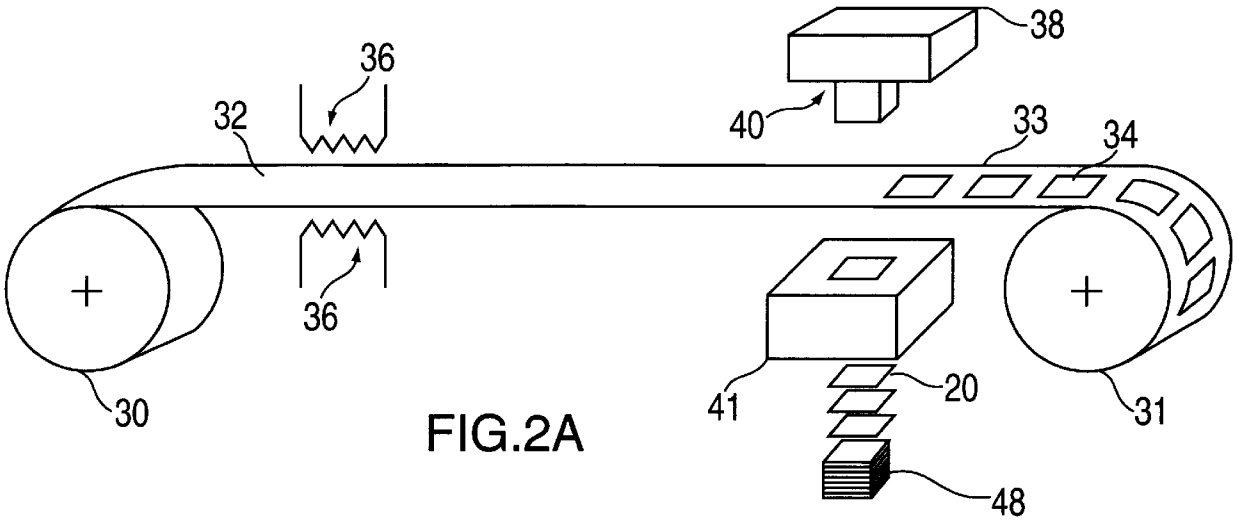
FIG. 2A is a side view of a coil of ferromagnetic amorphous metal strip positioned to be annealed and stamped, and of ferromagnetic amorphous metal laminations positioned to be stacked in accordance with the present invention.

A first embodiment of the invention is illustrated in FIG. 2A. A roll 30 of ferromagnetic amorphous metal strip material 32 is fed continuously through an annealing oven 36 which raises the temperature of the strip to a level and for a time sufficient to effect improvement in the magnetic properties of the strip. The strip material 32 is then passed into an automatic high-speed punch press 38 between a punch 40 and an open-bottom die 41. The punch is driven into the die causing a lamination 20 of the required shape to be formed. Lamination 20 then falls or is transported into a collecting magazine 48 and punch 40 is retracted. A skeleton 33 of strip material 32 remains and contains holes 34 from which laminations 20 have been removed. Skeleton 33 is collected on a take-up spool 31. After each punching action is accomplished, the strip 32 is indexed to prepare the strip for another punching cycle. Strip material 32 may be fed into press 38 either in a single layer or in multiple layers (not illustrated), either from multiple payoffs or by prior pre-spooling of multiple layers. Use of multiple layers of strip material 32 advantageously reduces the number of punch strokes required to produce a given number of laminations 20. As the punching process continues, a plurality of laminations 20 are collected in magazine 48 in sufficiently well-aligned registry. After a requisite number of laminations 20 are punched and deposited into the magazine, 48, the operation of punch press 38 is interrupted. The requisite number may either be pre-selected or may be determined by the height or weight of laminations 20 received in magazine 48. Magazine 48 is then removed from punch press 38 for further processing. A low-viscosity, heat-activated epoxy (not shown) may be allowed to infiltrate the spaces between laminations 20 which are maintained in registry by the walls of magazine 48. The epoxy is then activated by exposing the entire magazine 48 and laminations 20 contained therein to a source of heat for a time sufficient to effect the cure of the epoxy. The now laminated stack 10 (see FIGS. 1A–1C) of laminations 20 is removed and the surface of stack 10 finished by removing any excess epoxy.

Figure 2B:
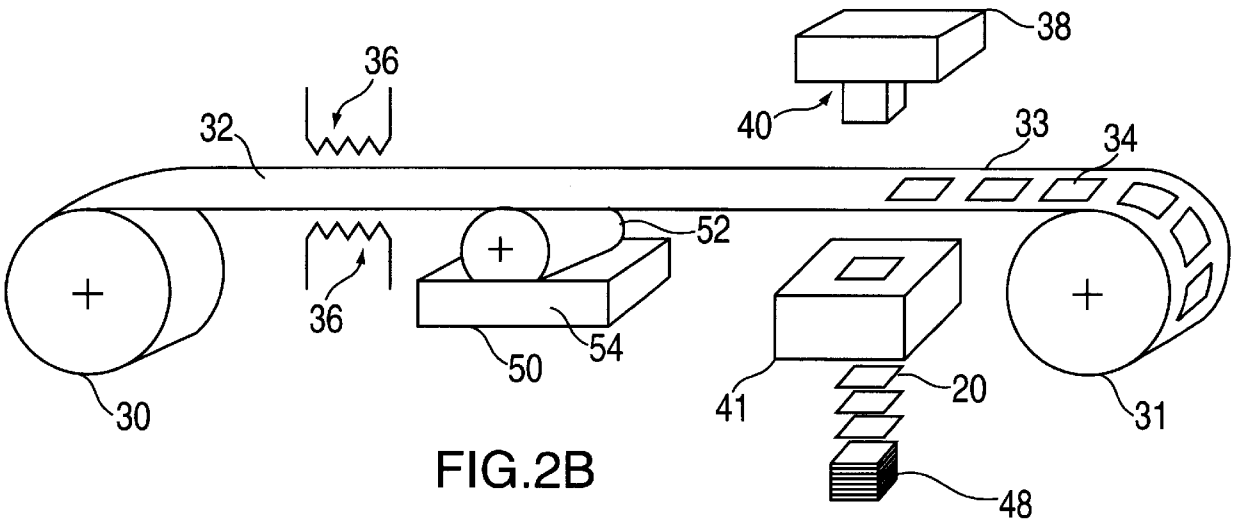
FIG. 2B is a side view of a coil of ferromagnetic amorphous metal strip positioned to be annealed, coated with an epoxy and stamped, and of ferromagnetic amorphous metal laminations positioned to be stacked in accordance with the present invention.

A second embodiment is shown in FIG. 2B. A roll 30 of ferromagnetic amorphous metal strip material 32 is fed continuously through an annealing oven 36 which raises its temperature to a level and for a time sufficient to effect improvement in the magnetic properties of strip 32. Strip 32 is then passed through an adhesive application means 50 comprising a gravure roller 52 onto which low-viscosity, heat-activated epoxy is supplied from adhesive reservoir 54. The epoxy is thereby transferred from roller 52 onto the lower surface of strip 32. The distance between annealing oven 36 and the adhesive application means 50 is sufficient to allow strip 32 to cool to a temperature at least below the thermal activation temperature of epoxy during the transit time of strip 32. Alternatively, cooling means (not illustrated) may be used to achieve a more rapid cooling of strip 32 between oven 36 and application means 50. Strip material 32 is then passed into an automatic high-speed punch press 38 and between a punch 40 and an open-bottom die 41. The punch is driven into the die causing a lamination 20 of the required shape to be formed. The lamination 20 then falls or is transported into a collecting magazine 48 and punch 40 is retracted. A skeleton 33 of strip material 32 remains and contains holes 34 from which laminations 20 have been removed. Skeleton 33 is collected on take-up spool 31. After each punching action is accomplished the strip 32 is indexed to prepare the strip for another punching cycle. The punching process is continued and a plurality of laminations 20 are collected in magazine 48 in sufficiently well-aligned registry. After a requisite number of laminations 20 are punched and deposited into the magazine 48, the operation of punch press 38 is interrupted. The requisite number may either be pre-selected or may be determined by the height or weight of laminations 20 received in magazine 48. Magazine 48 is then removed from punch press 38 for further processing. Additional low-viscosity, heat-activated epoxy (not shown) may be allowed to infiltrate the spaces between the laminations 20 which are maintained in registry by the walls of magazine 48. The epoxy is then activated by exposing the entire magazine 48 and laminations 20 contained therein to a source of heat for a time sufficient to effect the cure of the epoxy. The now laminated stack 10 (see FIGS. 1A–1C) of laminations 20 is removed from the magazine and the surface of stack 10 may be finished by removing any excess epoxy.

Figure 2C:
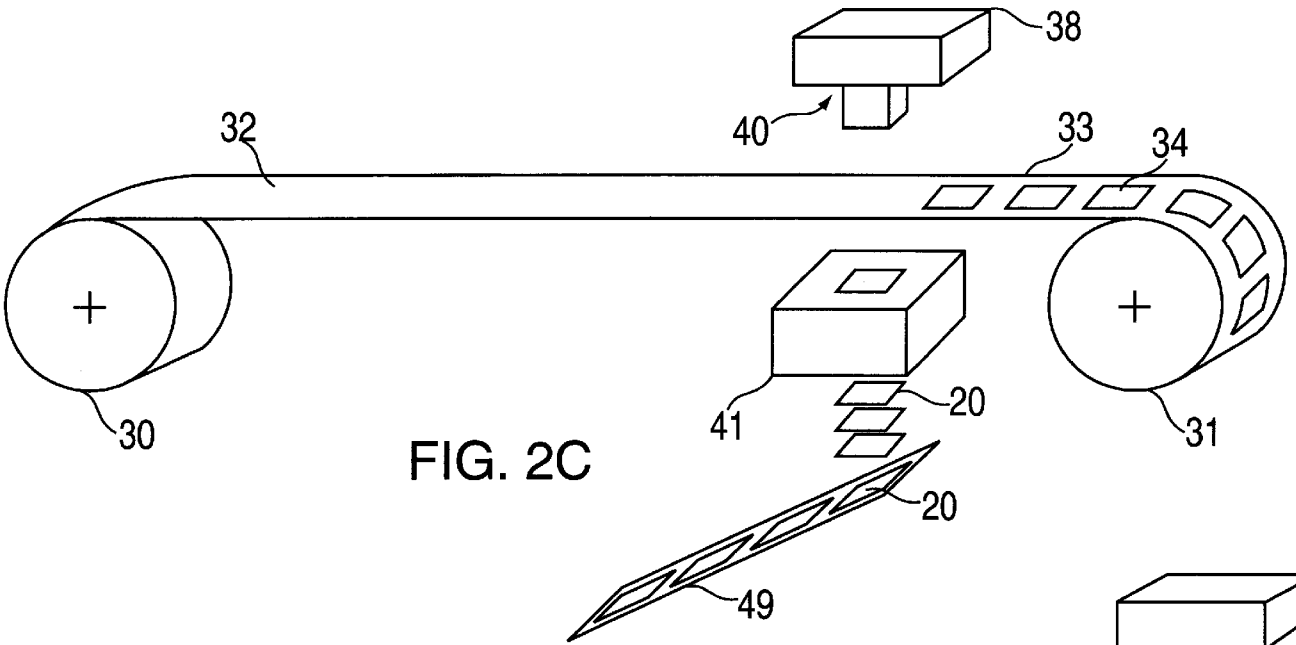
FIG. 2C is a side view of a coil of ferromagnetic amorphous metal strip positioned to be stamped, and of ferromagnetic amorphous metal laminations positioned to be collected in accordance with the present invention.

A third embodiment is shown in FIG. 2C. A ferromagnetic amorphous metal strip is first annealed in an inert gas box oven (not shown) at a pre-selected temperature and for a pre-selected time sufficient to effect improvement of its magnetic properties without altering the substantially fully glassy microstructure thereof. The heat treated strip 32 is then fed from roll 30 into an automatic high-speed punch press 38 and between a punch 40 and an open-bottom die 41. The punch is driven into the die causing a lamination 20 of the required shape to be formed. Lamination 20 then falls or is transported out of die 41 into a collection device 49 and punch 40 is retracted. The collection device 49 may be a conveyor belt as shown in FIG. 2C, or may be a container or vessel for collecting the laminations 20. A skeleton 33 of strip material 32 remains and contains holes 34 from which laminations 20 have been removed. Skeleton 33 is collected on take-up spool 31. After each punching action is accomplished, the strip 32 is indexed to prepare the strip for another punching cycle. The punching process is continued until a pre-selected number of laminations 20 are stamped and collected in a vessel, then the press cycle is stopped. One side of each lamination 20 may then be manually coated with an anaerobic adhesive and the laminations stacked in registry in an alignment fixture (not shown). The adhesive is allowed to cure. The now laminated stack 10 of laminations 20 is removed from the alignment fixture and the surface of stack 10 finished by removing any excess adhesive.

Figure 2D:
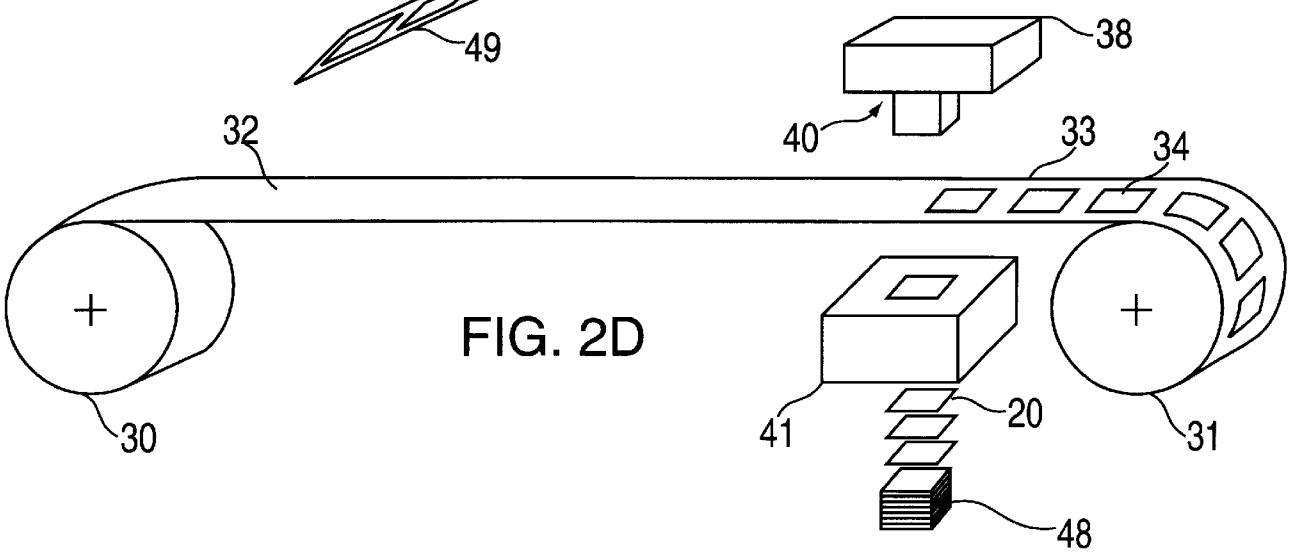
FIG. 2D is a side view of a coil of ferromagnetic amorphous metal strip positioned to be stamped, and of ferromagnetic amorphous metal laminations positioned to be stacked in accordance with the present invention.

Another embodiment is shown in FIG. 2D. A roll 30 of ferromagnetic amorphous metal strip material 32 is fed continuously into an automatic high-speed punch press 38 and between a punch 40 and an open-bottom die 41. The punch 40 is driven into the die 41 causing a lamination 20 of the required shape to be formed. Lamination 20 then falls into or is transported to a collecting magazine 48 and punch 40 is retracted. A skeleton. 33 of strip material 32 remains and contains holes 34 from which laminations 20 have been removed. Skeleton 33 is collected on take-up spool 31. After each punching action is accomplished, the strip 32 is indexed to prepare the strip for another punching cycle. Strip material 32 may be fed into press 38 either in a single layer or in multiple layers (not illustrated), either from multiple payoffs or by prior pre-spooling of multiple layers. Use of multiple layers of strip material 32 advantageously reduces the number of punch strokes required to produce a given number of laminations 20. The punching process is continued and a plurality of laminations 20 are collected in magazine 48 in sufficiently well-aligned registry. After a requisite number of laminations 20 are punched and deposited into magazine 48, the operation of punch press 38 is interrupted. The requisite number may either be pre-selected or may be determined by the height or weight of laminations 20 received in magazine 48. Magazine 48 is then removed from punch press 38 for further processing. In an implementation, magazine 48 and laminations 20 contained therein are placed in an inert gas box oven (not shown) and heat-treated by heating them to a pre-selected temperature and holding them at that temperature for a pre-selected time sufficient to effect improvement of its magnetic properties without altering the substantially fully glassy microstructure of the amorphous metal laminations. The magazine and laminations are then cooled to ambient temperature. A low-viscosity, heat-activated epoxy (not shown) is allowed to infiltrate the spaces between laminations 20 which are maintained in registry by the walls of magazine 48. Epoxy is then activated by placing the entire magazine 48 and laminations 20 contained therein in a curing oven for a time sufficient to effect the cure of the epoxy. The now laminated stack 10 (see FIGS. 1A–1C) of laminations 20 is removed and the surface of stack 10 finished by removing any excess epoxy.

Construction of bulk amorphous metal magnetic components in accordance with the present invention is especially suited for tiles for poleface magnets used in high performance MRI systems, in television and video systems, and in electron and ion beam systems. Magnetic component manufacturing is simplified and manufacturing time is reduced. Stresses otherwise encountered during the construction of bulk amorphous metal components are minimized. Magnetic performance of the finished components is optimized.

The bulk amorphous metal magnetic component 10 of the present invention can be manufactured using numerous ferromagnetic amorphous metal alloys. Generally stated, the alloys suitable for use in component 10 are defined by the formula: $M_{70\text{-}85}\ Y_{5\text{-}20}\ Z_{0\text{-}20}$, subscripts in atom percent, where "M" is at least one of Fe, Ni and Co, "Y" is at least one of B, C and P, and "Z" is at least one of Si, Al and Ge; with the proviso that (i) up to ten (10) atom percent of component "M" can be replaced with at least one of the metallic species Ti, V, Cr, Mn, Cu, Zr, Nb, Mo, Ta, Hf, Ag, Au, Pd, Pt, and W, (ii) up to ten (10) atom percent of components (Y+Z) can be replaced by at least one of the non-metallic species In, Sn, Sb and Pb, and (iii) up to about one (1) atom percent of the components (M+Y+Z) can be incidental impurities. As used herein, the term "amorphous metallic alloy" means a metallic alloy that substantially lacks any long range order and is characterized by X-ray diffraction intensity maxima which are qualitatively similar to those observed for liquids or inorganic oxide glasses.

The alloy suited for use in the practice of the present invention is ferromagnetic at the temperature at which the component is to be used. A ferromagnetic material is one which exhibits strong, long-range coupling and spatial alignment of the magnetic moments of its constituent atoms at a temperature below a characteristic temperature (generally termed the Curie temperature) of the material. It is preferred that the Curie temperature of material to be used in a device operating at room temperature be at least about 200° C. and preferably at least about 375° C. Devices may be operated at other temperatures, including down to cryogenic temperatures or at elevated temperatures, if the material to be incorporated therein has an appropriate Curie temperature.

As is known in the art, a ferromagnetic material may further be characterized by its saturation induction or equivalently, by its saturation flux density or magnetization. The alloy suitable for use in the present invention preferably has a saturation induction of at least about 1.2 tesla (T) and, more preferably, a saturation induction of at least about 1.5 T. The alloy also has high electrical resistivity, preferably at least about 100 $\mu\Omega$-cm, and most preferably at least about 130 $\mu\Omega$-cm.

Amorphous metal alloys suitable for use as feedstock in the practice of the invention are commercially available, generally in the form of continuous thin strip or ribbon in widths up to 20 cm or more and in thicknesses of approximately 20–25 $\mu$m. These alloys are formed with a substantially fully glassy microstructure (e.g., at least about 80% by volume of material having a non-crystalline structure). Preferably the alloys are formed with essentially 100% of the material having a non-crystalline structure. Volume fraction of non-crystalline structure may be determined by methods known in the art such as x-ray, neutron, or electron diffraction, transmission electron microscopy, or differential scanning calorimetry. Highest induction values at low cost are achieved for alloys wherein "M" is iron, "Y" is boron and "Z" is silicon. For this reason, amorphous metal strip composed of an iron-boron-silicon alloy is preferred. More specifically, it is preferred that the alloy contain at least 70 atom percent Fe, at least 5 atom percent B, and at least 5 atom percent Si, with the proviso that the total content of B and Si be at least 15 atom percent. Most preferred is amorphous metal strip having a composition consisting essentially of about 11 atom percent boron and about 9 atom percent silicon, the balance being iron and incidental impurities. This strip, having a saturation induction of about 1.56 T and a resistivity of about 137 $\mu\Omega$-cm, is sold by Honeywell International Inc. under the trade designation METGLAS® alloy 2605SA-1. It will be appreciated by those skilled in the art that embodiments of the invention which entail continuous, automatic feeding of feedstock material through a stamping press may conveniently employ, for example, amorphous metal supplied as spools of thin ribbon or strip. Alternatively, the invention may be practiced with other forms of feedstock and other feeding schemes, including manual feeding of shorter lengths of strip or other shapes not having a uniform width.

An electromagnet system comprising an electromagnet having one or more poleface magnets is commonly used to produce a time-varying magnetic field in the gap of the electromagnet. The time-varying magnetic field may be a purely AC field, i.e. a field whose time average value is zero. Optionally the time varying field may have a non-zero time average value conventionally denoted as the DC component of the field. In the electromagnet system, the at least one poleface magnet is subjected to the time-varying magnetic field. As a result, the pole face magnet is magnetized and demagnetized with each excitation cycle. The time-varying magnetic flux density or induction within the poleface magnet causes the production of heat from core loss therein. In the case of a pole face comprised of a plurality of bulk magnetic components, the total loss is a consequence both of the core loss which would be produced within each component if subjected in isolation to the same flux waveform and of the loss attendant to eddy currents circulating in paths which provide electric continuity between the components.

Bulk amorphous magnetic components will magnetize and demagnetize more efficiently than components made from other iron-base magnetic metals. When used as a pole magnet, the bulk amorphous metal component will generate less heat than a comparable component made from another iron-base magnetic metal when the two components are magnetized at identical induction and excitation frequency. Furthermore, iron-base amorphous metals preferred for use in the present invention have significantly greater saturation induction than do other low loss soft magnetic materials such as permalloy alloys, whose saturation induction is typically 0.6–0.9 T. The bulk amorphous metal component can therefore be designed to operate 1) at a lower operating temperature; 2) at higher induction to achieve reduced size and weight; or, 3) at higher excitation frequency to achieve reduced size and weight, or to achieve superior signal resolution, when compared to magnetic components made from other iron-base magnetic metals.

The prior art recognizes that eddy currents in pole pieces comprising elongated ferromagnetic rods may be reduced by electrically isolating those rods from each other by interposed electrically non-conducting material. The present invention affords a substantial further reduction in the total losses, because the use of the material and construction methods taught herein reduces the losses arising within each individual component from those which would be exhibited in a prior art component made with other materials or construction methods.

As is known in the art, core loss is that dissipation of energy which occurs within a ferromagnetic material as the magnetization thereof is changed with time. The core loss of a given magnetic component is generally determined by cyclically exciting the component. A time-varying magnetic field is applied to the component to produce therein a corresponding time variation of the magnetic induction or flux density. For the sake of standardization of measurement, the excitation is generally chosen such that the magnetic induction varies sinusoidally with time at a frequency "f" and with a peak amplitude "$B_{max}$." The core loss is then determined by known electrical measurement instrumentation and techniques. Loss is conventionally reported as watts per unit mass or volume of the magnetic material being excited. It is known in the art that loss increases monotonically with f and $B_{max}$. Most standard protocols for testing the core loss of soft magnetic materials used in components of poleface magnets (e.g. ASTM Standards A912-93 and A927 (A927M-94)) call for a sample of such materials which is situated in a substantially closed magnetic circuit, i.e. a configuration in which closed magnetic flux lines are completely contained within the volume of the sample. On the other hand, a magnetic material as employed in a component such as a poleface magnet is situated in a magnetically open circuit,. i.e. a configuration in which magnetic flux lines must traverse an air gap. Because of fringing field effects and non-uniformity of the field, a given material tested in an open circuit generally exhibits a higher core loss, i.e. a higher value of watts per unit mass or volume, than it would have in a closed-circuit measurement. The bulk magnetic component of the invention advantageously exhibits low core loss over a wide range of flux densities and frequencies even in an open-circuit configuration.

Without being bound by any theory, it is believed that the total core loss of the low-loss bulk amorphous metal component of the invention is comprised of contributions from hysteresis losses and eddy current losses. Each of these two contributions is a function of the peak magnetic induction $B_{max}$ and of the excitation frequency f. The magnitude of each contribution is further dependent on extrinsic factors including the method of component construction and the thermomechanical history of the material used in the component. Prior art analyses of core losses in amorphous metals (see, e.g., G. E. Fish, J. Appl. Phys. 57, 3569(1985) and G. E. Fish et al., J. Appl. Phys. 64, 5370(1988)) have generally been restricted to data obtained for material in a closed magnetic circuit. The low hysteresis and eddy current losses seen in these analyses are driven in part by the high resistivities of amorphous metals.

The total core loss $L(B_{max}, f)$ per unit mass of the bulk magnetic component of the invention may be essentially defined by a function having the form $$L(B_{max}, f)=c_1 f(B_{max})^n+c_2 f^q (B_{max})^m$$

wherein the coefficients $c_1$ and $c_2$ and the exponents n, m, and q must all be determined empirically, there being no known theory that precisely determines their values. Use of this formula allows the total core loss of the bulk magnetic component of the invention to be determined at any required operating induction and excitation frequency. It is generally found that in the particular geometry of a bulk magnetic component the magnetic field therein is not spatially uniform. Techniques such as finite element modeling are known in the art to provide an estimate of the spatial and temporal variation of the peak flux density that closely approximates the flux density distribution measured in an actual bulk magnetic component. Using as input a suitable empirical formula giving the magnetic core loss of a given material under spatially uniform flux density, these techniques allow the corresponding actual core loss of a given component in its operating configuration to be predicted with reasonable accuracy.

The measurement of the core loss of the magnetic component of the invention can be carried out using various methods known in the art. One method suited for measuring the present component comprises forming a magnetic circuit with the magnetic component of the invention and a flux closure structure means. In another method the magnetic circuit may comprise a plurality of magnetic components of the invention and optionally a flux closure structure means. Generally stated, the flux closure structure means comprises soft magnetic material having high permeability and a saturation flux density at least equal to the flux density at which the component is to be tested. Preferably, the soft magnetic material has a saturation flux density at least equal to the saturation flux density of the component. The flux direction along which a component is to be tested generally defines first and second opposite faces of the component. Flux lines enter the component in a direction generally normal to the plane of the first opposite face. The flux lines generally follow the plane of the amorphous metal strips of the component, and emerge from the second opposing face. The flux closure structure means generally comprises a flux closure magnetic component. Such a component could be constructed in accordance with the present invention but may also be made with other methods and materials known in the art. The flux closure magnetic component also has first and second opposing faces through which flux lines enter and emerge, generally normal to the respective planes thereof. The flux closure component's opposing faces are substantially the same size and shape as the corresponding faces of the magnetic component to which the flux closure component is mated during actual testing. The flux closure magnetic component is placed in mating relationship with its first and second faces closely proximate and substantially parallel to the first and second faces of the magnetic component of the invention, respectively. Magnetomotive force is applied by passing current through a first winding encircling either the magnetic component of the invention or the flux closure magnetic component. The resulting flux density is determined by Faraday's law from the voltage induced in a second winding encircling the magnetic component to be tested. The applied magnetic field is determined by Ampere's law from the magnetomotive force. The core loss is then computed from the applied magnetic field and the resulting flux density by conventional methods.

Figure 3:
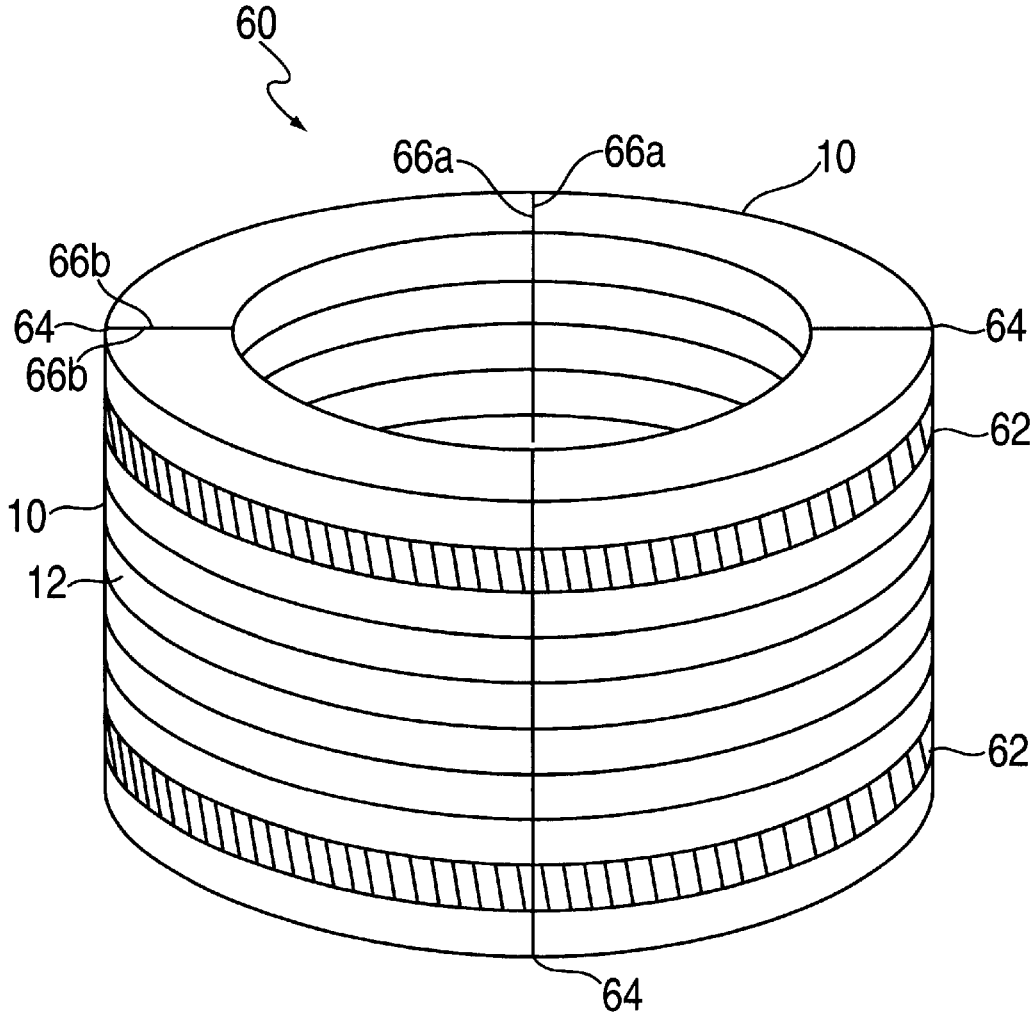
FIG. 3 is a perspective view of an assembly for testing bulk stamped amorphous metal magnetic components, comprising four components, each having the shape of a polyhedron with oppositely disposed arcuate surfaces, and assembled to form a generally right circular, annular cylinder.

Referring to FIG. 3, there is illustrated an assembly 60 for carrying out one form of the testing method described above which does not require a flux closure structure means. Assembly 60 comprises four bulk stamped amorphous metal magnetic components 10 of the invention. Each of the components 10 is a right circular, annular, cylindrical segment with arcuate surfaces 12 of the form depicted in FIG. 1C. Each component has a first opposite face 66*a* and a second opposite face 66*b*. The components 10 are situated in mating relationship to form assembly 60 which generally has the shape of a right circular cylinder. First opposite face 66*a* of each component 10 is located proximate to, and generally aligned parallel with, the corresponding first opposite face 66*a* of the component 10 adjacent thereto. The four sets of adjacent faces of components 10 thus define four gaps 64 equally spaced about the circumference of assembly 60. The mating relationship of components 10 may be secured by bands 62. Assembly 60 forms a magnetic circuit with four permeable segments (each comprising one component 10) and four gaps 64. Two copper wire windings (not shown) are toroidally threaded through the assembly 60. An alternating current of suitable magnitude is passed through the first winding to provide a magnetomotive force that excites assembly at the requisite frequency and peak flux density. Flux lines are generally within the plane of strips 20 and directed circumferentially. Voltage indicative of the time varying flux density within each of components 10 is induced in the second winding. The total core loss is determined by conventional electronic means from the measured values of voltage and current and apportioned equally among the four components 10.

The following examples are provided to more completely describe the present invention. The specific techniques, conditions, materials, proportions and reported data set forth to illustrate the principles and practice of the invention are exemplary only and should not be construed as limiting the scope of the invention.

EXAMPLE 1

Preparation And Electro-Magnetic Testing of a Stamped Amorphous Metal Arcuate Component $Fe_{80}B_{11}Si_9$ ferromagnetic amorphous metal ribbon, approximately 60 mm wide and 0.022 mm thick, is stamped to form individual laminations, each having the shape of a 90° segment of an annulus 100 mm in outside diameter and 75 mm in inside diameter. Approximately 500 individual laminations are stacked and registered to form a 90° arcuate segment of a right circular cylinder having a 12.5 mm height, a 100 mm outside diameter, and a 75 mm inside diameter, as illustrated in FIG. 1*c*. The cylindrical segment assembly is placed in a fixture and annealed in a nitrogen atmosphere. The anneal consists of: 1) heating the assembly up to 365° C.; 2) holding the temperature at approximately 365° C. for approximately 2 hours; and, 3) cooling the assembly to ambient temperature. The cylindrical segment assembly is removed from the fixture. The cylindrical segment assembly is placed in a second fixture, vacuum impregnated with an epoxy resin solution, and cured at 120° C. for approximately 4.5 hours. When fully cured, the cylindrical segment assembly is removed from the second fixture. The resulting epoxy bonded, amorphous metal cylindrical segment assembly weighs approximately 70 g. The process is repeated to form a total of four such assemblies. The four assemblies are placed in mating relationship and banded to form a generally cylindrical test assembly having four equally spaced gaps, as depicted in FIG. 3. Primary and secondary electrical windings are fixed to the cylindrical test assembly for electrical testing.

The test assembly exhibits core loss values of less than 1 watt-per-kilogram of amorphous metal material when operated at a frequency of approximately 60 Hz and at a flux density of approximately 1.4 Tesla (T), a core-loss of less than 12 watts-per-kilogram of amorphous metal material when operated at a frequency of approximately 1000 Hz and at a flux density of approximately 1.0 T, and a core-loss of less than 70 watt-per-kilogram of amorphous metal material when operated at a frequency of approximately 20,000 Hz and at a flux density of approximately 0.30T. The low core loss of the components of the invention renders them suitable for use in constructing a magnetic poleface.

EXAMPLE 2

High Frequency Electro-Magnetic Testing of a Stamped Amorphous Metal Arcuate Component A cylindrical test assembly comprising four stamped amorphous metal arcuate components is prepared as in Example 1. Primary and secondary electrical windings are fixed to the test assembly. Electrical testing is carried out at 60, 1000, 5000, and 20,000 Hz and at various flux densities. Core loss values are compiled in Tables 1, 2, 3, and 4 below. As shown in Tables 3 and 4, the core loss is particularly low at excitation frequencies of 5000 Hz or higher. Thus, the magnetic component of the invention is especially suited for use in poleface magnets for MRI systems.

TABLE 1

| | Core Loss @ 60 Hz (W/kg) | | | | |
|---|---|---|---|---|---|
| | Material | | | | |
| Flux Density | Amorphous $Fe_{80}B_{11}Si_9$ (22 μm) | Crystalline Fe - 3% Si (25 μm) National-Arnold Magnetics Silectron | Crystalline Fe - 3% Si (50 μm) National-Arnold Magnetics Silectron | Crystalline Fe - 3% Si (175 μm) National-Arnold Magnetics Silectron | Crystalline Fe - 3% Si (275 μm) National-Arnold Magnetics Silectron |
| 0.3 T | 0.10 | 0.2 | 0.1 | 0.1 | 0.06 |
| 0.7 T | 0.33 | 0.9 | 0.5 | 0.4 | 0.3 |
| 0.8 T | | 1.2 | 0.7 | 0.6 | 0.4 |
| 1.0 T | | 1.9 | 1.0 | 0.8 | 0.6 |
| 1.1 T | 0.59 | | | | |
| 1.2 T | | 2.6 | 1.5 | 1.1 | 0.8 |
| 1.3 T | 0.75 | | | | |
| 1.4 T | 0.85 | 3.3 | 1.9 | 1.5 | 1.1 |

TABLE 2

| | Core Loss @ 1,000 Hz (W/kg) | | | | |
|---|---|---|---|---|---|
| | Material | | | | |
| Flux Density | Amorphous $Fe_{80}B_{11}Si_9$ (22 μm) | Crystalline Fe - 3% Si (25 μm) National-Arnold Magnetics Silectron | Crystalline Fe - 3% Si (50 μm) National-Arnold Magnetics Silectron | Crystalline Fe - 3% Si (175 μm) National-Arnold Magnetics Silectron | Crystalline Fe - 3% Si (275 μm) National-Arnold Magnetics Silectron |
| 0.3 T | 1.92 | 2.4 | 2.0 | 3.4 | 5.0 |
| 0.5 T | 4.27 | 6.6 | 5.5 | 8.8 | 12 |
| 0.7 T | 6.94 | 13 | 9.0 | 18 | 24 |
| 0.9 T | 9.92 | 20 | 17 | 28 | 41 |
| 1.0 T | 11.51 | 24 | 20 | 31 | 46 |
| 1.1 T | 13.46 | | | | |
| 1.2 T | 15.77 | 33 | 28 | | |
| 1.3 T | 17.53 | | | | |
| 1.4 T | 19.67 | 44 | 35 | | |

TABLE 3

| | Core Loss @ 5,000 Hz (W/kg) | | | |
|---|---|---|---|---|
| | Material | | | |
| Flux Density | Amorphous $Fe_{80}B_{11}Si_9$ (22 μm) | Crystalline Fe - 3% Si (25 μm) National-Arnold Magnetics Silectron | Crystalline Fe - 3% Si (50 μm) National-Arnold Magnetics Silectron | Crystalline Fe - 3% Si (175 μm) National-Arnold Magnetics Silectron |
| 0.04 T | 0.25 | 0.33 | 0.33 | 1.3 |
| 0.06 T | 0.52 | 0.83 | 0.80 | 2.5 |
| 0.08 T | 0.88 | 1.4 | 1.7 | 4.4 |
| 0.10 T | 1.35 | 2.2 | 2.1 | 6.6 |
| 0.20 T | 5 | 8.8 | 8.6 | 24 |
| 0.30 T | 10 | 18.7 | 18.7 | 48 |

TABLE 4

| | Core Loss @ 20,000 Hz (W/kg) | | | |
|---|---|---|---|---|
| | Material | | | |
| Flux Density | Amorphous $Fe_{80}B_{11}Si_9$ (22 μm) | Crystalline Fe - 3% Si (25 μm) National-Arnold Magnetics Silectron | Crystalline Fe - 3% Si (50 μm) National-Arnold Magnetics Silectron | Crystalline Fe - 3% Si (175 μm) National-Arnold Magnetics Silectron |
| 0.04 T | 1.8 | 2.4 | 2.8 | 16 |
| 0.06 T | 3.7 | 5.5 | 7.0 | 33 |
| 0.08 T | 6.1 | 9.9 | 12 | 53 |
| 0.10 T | 9.2 | 15 | 20 | 88 |
| 0.20 T | 35 | 57 | 82 | |
| 0.30 T | 70 | 130 | | |

EXAMPLE 3

High Frequency Behavior of Low-Loss Bulk Amorphous Metal Components

The core loss data of Example 2 above are analyzed using conventional non-linear regression methods. It is determined that the core loss of a low-loss bulk amorphous metal component comprised of $Fe_{80}B_{11}Si_9$ amorphous metal ribbon can be essentially defined by a function having the form $$L(B_{max}, f)=c_1 f(B_{max})^n+c_2 f^q(B_{max})^m.$$

Suitable values of the coefficients $c_1$ and $c_2$ and the exponents n, m, and q are selected to define an upper bound to the magnetic losses of the bulk amorphous metal component. Table 5 recites the losses of the component in Example 2 and the losses predicted by the above formula, each measured in watts per kilogram. The predicted losses as a function of f (Hz) and $B_{max}$ (Tesla) are calculated using the coefficients $c_1$=0.0074 and $c_2$=0.000282 and the exponents n=1.3, m=2.4, and q=1.5. The loss of the bulk amorphous metal component of Example 2 is less than the corresponding loss predicted by the formula.

TABLE 5

| Point | $B_{max}$ (Tesla) | Frequency (Hz) | Core Loss of Example 1 (W/kg) | Predicted Core Loss (W/kg) |
|---|---|---|---|---|
| 1 | 0.3 | 60 | 0.1 | 0.10 |
| 2 | 0.7 | 60 | 0.33 | 0.33 |
| 3 | 1.1 | 60 | 0.59 | 0.67 |
| 4 | 1.3 | 60 | 0.75 | 0.87 |
| 5 | 1.4 | 60 | 0.85 | 0.98 |
| 6 | 0.3 | 1000 | 1.92 | 2.04 |
| 7 | 0.5 | 1000 | 4.27 | 4.69 |
| 8 | 0.7 | 1000 | 6.94 | 8.44 |
| 9 | 0.9 | 1000 | 9.92 | 13.38 |
| 10 | 1 | 1000 | 11.51 | 16.32 |
| 11 | 1.1 | 1000 | 13.46 | 19.59 |
| 12 | 1.2 | 1000 | 15.77 | 23.19 |
| 13 | 1.3 | 1000 | 17.53 | 27.15 |
| 14 | 1.4 | 1000 | 19.67 | 31.46 |
| 15 | 0.04 | 5000 | 0.25 | 0.61 |
| 16 | 0.06 | 5000 | 0.52 | 1.07 |
| 17 | 0.08 | 5000 | 0.88 | 1.62 |
| 18 | 0.1 | 5000 | 1.35 | 2.25 |
| 19 | 0.2 | 5000 | 5 | 6.66 |
| 20 | 0.3 | 5000 | 10 | 13.28 |
| 21 | 0.04 | 20000 | 1.8 | 2.61 |
| 22 | 0.06 | 20000 | 3.7 | 4.75 |
| 23 | 0.08 | 20000 | 6.1 | 7.41 |
| 24 | 0.1 | 20000 | 9.2 | 10.59 |
| 25 | 0.2 | 20000 | 35 | 35.02 |
| 26 | 0.3 | 20000 | 70 | 75.29 |

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A low-loss bulk amorphous metal magnetic component, comprising a plurality of similarly shaped laminations stamped from ferromagnetic amorphous metal strips, stacked and adhesively bonded together to form a polyhedrally shaped part, and wherein said component when operated at an excitation frequency "f" to a peak induction level $B_{max}$ has a core-loss less than "L" wherein L is given by the formula $L=0.0074\ f(B_{max})^{1.3}+0.000282\ f^{1.5}\ (B_{max})^{2.4}$, said core loss, said excitation frequency and said peak induction level being measured in watts per kilogram, hertz, and teslas, respectively.

2. A bulk amorphous metal magnetic component as recited by claim 1, each of said ferromagnetic amorphous metal strips having a composition defined essentially by the formula: $M_{70\text{-}85}\ Y_{5\text{-}20},\ Z_{0\text{-}20}$, subscripts in atom percent, where "M" is at least one of Fe, Ni and Co, "Y" is at least one of B, C and P, and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta, Hf, Ag, Au, Pd, Pt, and W, (ii) up to 10 atom percent of components (Y+Z) can be replaced by at least one of the non-metallic species In, Sn, Sb and Pb and (iii) up to about one (1) atom percent of the components (M+Y+Z) can be incidental impurities.

3. A bulk amorphous metal magnetic component as recited by claim 2, wherein each of said ferromagnetic amorphous metal strips has a composition containing at least 70 atom percent Fe, at least 5 atom percent B, and at least 5 atom percent Si, with the proviso that the total content of B and Si is at least 15 atom percent.

4. A bulk amorphous metal magnetic component as recited by claim 3, wherein each of said ferromagnetic amorphous metal strips has a composition defined essentially by the formula $Fe_{80}B_{11}Si_9$.

5. A bulk amorphous metal magnetic component as recited by claim 1, wherein said component has the shape of a three-dimensional polyhedron with at least one rectangular cross-section.

6. A bulk amorphous metal magnetic component as recited by claim 1, wherein said component has the shape of a three-dimensional polyhedron with at least one trapezoidal cross-section.

7. A bulk amorphous metal magnetic component as recited by claim 1, wherein said component has the shape of a three-dimensional polyhedron with at least one square cross-section.

8. A bulk amorphous metal magnetic component as recited by claim 1, wherein said component includes at least one arcuate surface.

9. A low-loss bulk amorphous metal magnetic component comprising a plurality of similarly shaped laminations stamped from ferromagnetic amorphous metal strips, stacked and adhesively bonded together to form a polyhedrally shaped part, said amorphous metal strips having a saturation induction of at least about 1.2 tesla, and said component when operated at an excitation frequency "f" to a peak induction level $B_{max}$ has a core-loss less than "L" wherein L is given by the formula $L=0.0074\ f(B_{max})^{1.3}+0.000282\ f^{1.5}(B_{max})^{2.4}$, said core loss, said excitation frequency and said peak induction level being measured in watts per kilogram, hertz, and teslas, respectively.

10. A low-loss bulk amorphous metal magnetic component comprising a plurality of similarly shaped laminations stamped from ferromagnetic amorphous metal strips, stacked and adhesively bonded together to form a polyhedrally shaped part, wherein each of the amorphous metal strips has a composition defined essentially by the formula: $M_{70\text{-}85}\ Y_{5\text{-}20}\ Z_{0\text{-}20}$, subscripts in atom percent, where "M" is at least one of Fe, Ni and Co, "Y" is at least one of B, C and P, and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta, Hf, Ag, Au, Pd, Pt, and W, (ii) up to 10 atom percent of components (Y+Z) can be replaced by at least one of the non-metallic species In, Sn, Sb and Pb and (iii) up to about one (1) atom percent of the components (M+Y+Z) can be incidental impurities, and wherein said component when operated at an excitation frequency "f" to a peak induction level $B_{max}$ has a core-loss less than "L" wherein L is given by the formula $L=0.0074\ f(B_{max})^{1.3}+0.000282\ f^{1.5}(B_{max})^{2.4}$, said core loss, said excitation frequency and said peak induction level being measured in watts per kilogram, hertz, and teslas, respectively.

11. A low-loss bulk amorphous metal magnetic component comprising a plurality of similarly shaped laminations stamped from ferromagnetic amorphous metal strips, stacked and adhesively bonded together to form a polyhedrally shaped part, wherein each of said ferromagnetic amorphous metal strips has a composition containing at least 70 atom percent Fe, at least 5 atom percent B, and at least 5 atom percent Si, with the proviso that the total content of B and Si is at least 15 atom percent, and wherein said component when operated at an excitation frequency "f" to a peak induction level $B_{max}$ has a core-loss less than "L" wherein L is given by the formula $L=0.0074\ f(B_{max})^{1.3}+0.000282\ f^{1.5}(B_{max})^{2.4}$, said core loss, said excitation frequency and said peak induction level being measured in watts per kilogram, hertz, and teslas, respectively.

* * * * *